United States Patent [19]

Jacobs et al.

[11] Patent Number: 4,809,397

[45] Date of Patent: Mar. 7, 1989

[54] RUG AND CARPET CLEANER

[75] Inventors: Paul G. Jacobs, Northridge; Bonifacio N. Avecilla, Alhambra; Norman Lapworth, Los Angeles, all of Calif.

[73] Assignee: Edic, Los Angeles, Calif.

[21] Appl. No.: 821,543

[22] Filed: Jan. 21, 1986

[51] Int. Cl.[4] ..... A47L 7/00

[52] U.S. Cl. ..... 15/320; 15/321; 15/334; 15/353; 15/410

[58] Field of Search ..... 15/410, 320, 321, 353, 15/328, 334, 331

[56] References Cited

U.S. PATENT DOCUMENTS

| | | | |
|---|---|---|---|
| 2,557,216 | 6/1951 | Calabrese | 15/320 X |
| 3,774,261 | 11/1973 | Colt | 15/321 |
| 3,848,291 | 11/1974 | Morse | 15/321 X |
| 3,879,797 | 4/1975 | Principe et al. | 15/334 |
| 4,014,067 | 3/1977 | Bates | 15/322 X |
| 4,136,420 | 1/1979 | Cyphert et al. | 15/321 |
| 4,153,968 | 5/1979 | Perkins | 15/321 |
| 4,159,554 | 7/1979 | Knight et al. | 15/321 |
| 4,167,798 | 9/1979 | Klügl et al. | 15/334 X |
| 4,167,799 | 9/1979 | Webb | 15/322 X |
| 4,272,861 | 6/1981 | Notta et al. | 15/322 X |
| 4,558,484 | 12/1985 | Groth | 15/320 |
| 4,598,440 | 7/1986 | Wilson | 15/410 X |

FOREIGN PATENT DOCUMENTS

| | | | |
|---|---|---|---|
| 1137016 | 1/1957 | France | 15/320 |
| 1152438 | 9/1957 | France | 15/320 |
| 486499 | 6/1938 | United Kingdom | 15/320 |

*Primary Examiner*—Chris K. Moore

*Attorney, Agent, or Firm*—Kelly, Bauersfeld & Lowry

[57] ABSTRACT

A mobile rug or carpet cleaner is provided with a support housing having front and rear wheels mounted so that the unit is tilted about the housing axis of the front wheels to engage and disengage a cleaning head with the carpet to be cleaned. The cleaner includes a fluid delivery system which provides fluid flow to the cleaning head, an auxiliary cleaning head and a spotter. The fluid delivery system utilizes a pump having an open conduit which continuously recycles cleaning fluid to a reservoir. The continuous recycle allows a solenoid valve in a line transporting fluid to the cleaning head spray nozzles to be abruptly closed without subjecting the entire fluid delivery system to a sudden, potentially damaging increase in fluid pressure. An automatic drain system utilizes a vacuum line to direct spent cleaning fluid to a removable waste tank for disposal. Suction can be selectively directed to the cleaning head or to the auxiliary head.

25 Claims, 7 Drawing Sheets

RUG AND CARPET CLEANER

BACKGROUND OF THE INVENTION

This invention generally relates to cleaning devices and specifically to cleaning devices for rugs and carpets.

Most of the prior art devices for cleaning rugs and carpets have consisted basically of a system for delivering cleaning solution (usually a hot aqueous detergent solution) to the rug or carpet and a system for vacuuming the applied cleaning solution from the rug or carpet. Many of the prior art devices had rotating brushes or beater bars to work the cleaning solution into the rug or carpet and to aid in the dislodging of dirt and other debris from the fibers of the rug or carpet.

The delivery system for the cleaning solution usually included a reservoir or tank for holding the solution, a pump for pumping solution from the tank to a cleaning head having one or more nozzles to apply the cleaning solution onto an underlying rug or carpet to be cleaned.

The vacuum system generally comprised a vacuum chamber or nozzle disposed in the cleaning head which is positioned over the rug or cleaner to aspirate applied cleaning solution, dirt and other debris from the rug or carpet, and a vacuum pump in fluid communication with the vacuum chamber or nozzle to generate a partial vacuum therein.

There are two variations of the basic system found in the marketplace. In one embodiment, the cleaning head, the solution delivery system, the vacuum system and one or more solution tanks are integrated into a single wheeled housing which is pulled over the rug or carpet by the operator. The other embodiment is similar to the first except that the cleaning head is a separate unit from a wheeled housing containing the vacuum system, the solution delivery system and the solution tanks. Vacuum tubes and solution delivery tubes are provided to interconnect the separate cleaning head with the respective vacuum and solution delivery systems in the wheeled housing. In this latter embodiment, the separate cleaning head is usually provided with an elongated, metal or rigid plastic vacuum tube connection which is used as a handle to facilitate movement of the cleaning head over the rug or carpet by the operator.

Both embodiments have advantages and disadvantages. For example, the cleaning unit having a separate cleaning head is easier to manipulate over a rug or carpet surface during the operation thereof, but because of the additional distance the fresh solution must be pumped to the cleaning head and the spent solution must be transferred back to the housing after the aspiration thereof from the rug or carpet, the power requirements for both the solution pump and the vacuum pump are substantially increased. Moreover, the connections for the tubings for the separate cleaning head present maintenance problems because they frequently leak solution.

The cleaning devices which are completely contained in a wheeled housing are most desirable from a manufacturing and maintenance point of view but they are very difficult to move over a rug or carpet surface during the cleaning thereof. As a result of this latter difficulty in operating the integrated units, their use has been limited to professional or commercial rug and carpet cleaners.

Both types of prior cleaning devies required frequent repair of leaking solution lines and connections due to the frequent abrupt application of high fluid pressure to the solution delivery lines during the operation of the cleaning unit.

Additionally, although the prior cleaning devices which employed rotating brushes or beater bars in the cleaning head provided improved cleaning, they caused very rapid wear of the rug and carpet fibers.

The present invention is directed to improvements in the rug and carpet cleaning devices. More specifically, the invention responds to the need to make cleaning devices easier to manipulate during use thereof and the need to make such cleaning devices more efficient in their operation and less costly to build and maintain.

SUMMARY OF THE INVENTION

The present invention is directed to an improved rug and carpet cleaner and particularly such a cleaning unit wherein a cleaning head, a cleaning solution delivery system, a tank for holding the cleaning solution and vacuum system for removing the applied solution from the rug or carpet are integrated into a wheeled mobile support housing.

In accordance with the invention, the cleaning device is provided with front wheels on each side of the housing and at least one rear wheel disposed at the rear of the cleaning unit to support the cleaning device in a generally upright position. The two front wheels are mounted on a common axis of rotation which is disposed in front of or at least aligned with the center of gravity of the cleaning unit when the unit is in an upright position. However, when the cleaning unit is tilted forwardly about the axis of rotation of the front wheels so that the cleaning head engages the rug or carpet for cleaning, the axis of rotation is rearward of the center of gravity so that the cleaning unit remains in the tilted position during the cleaning process.

The front wheels are mounted in a generally central location underneath the cleaning unit and such mounting of the front wheels results in a substantial frontal overhang of the housing which contains the cleaning head. The cleaner unit is easily moved into a desired location when it is in an upright position by rolling on both the front and rear wheels. When the unit is to be operated to clean rugs or carpets, it is tilted so that a cleaning head in the front overhang engages the rug or carpet and then it is pulled rearwardly rolling on the front wheels alone while the cleaning head contacts the rug or carpet surface.

The fluid delivery system comprises a conduit which leads cleaning fluid from the container holding same to a pump which directs the fluid to one or more nozzles provided in the cleaning head. The spray nozzles apply the cleaning fluid to the rug or carpet.

The vacuum system comprises a vacuum source or pump which is maintained in fluid communication through one or more conduits to a vacuum chamber or nozzle in the cleaning head. Preferably, a sealed container is provided in fluid communication with the conduit leading from the vacuum chamber to the vacuum source wherein the spent cleaning solution is separated along with dirt and other debris from the carrier air stream.

The invention also includes the utilization of an oscillating brush for working the cleaning solution into the rug and dislodging dirt and debris therefrom to enhance the cleaning thereof without causing undue wear or damage to the carpet fibers. The brush, which is preferably located in the cleaning head, oscillates through an angle less than about 90° at a frequency between about 10 to 120 Hz.

Furthermore, the invention includes a conduit for recirculating the cleaning solution from the pump back to the reservoir or tank holding the solution in order to moderate the effects of the frequent and abrupt application of high pressure to the solution delivery system which can cause leaks in the solution pump seals and the connections between the tubing, elbows and the like of the system. The flow of cleaning solution in the conduit from the cleaning solution pump to the spray nozzles in the cleaning head is controlled by a solenoid valve therein which is preferably actuated by a switch on the handle on the cleaning unit.

In accordance with other embodiments of the invention, an auxiliary cleaning head is provided having a solution delivery line to direct solution from the cleaning solution pump to the auxiliary cleaning head and a vacuum line to direct spent cleaning solution aspirated from the rug or carpet by the auxiliary head to the vacuum system. A hand operated spray nozzle in fluid communication is also provided which is supplied with cleaning solution to apply cleaning solution to areas of the rug or carpet which need additional cleaning solution. By controlling the flow of cleaning solution to the main cleaning head by a solenoid valve, the solution lines to the auxiliary cleaning head and the spotting unit can be maintained under pressure during normal operation of the cleaner so they are available for immediate use.

These and other advantages of the invention will become more apparent from the following detailed description of the invention and the accompanying exemplary drawings.

In all of the aforesaid drawings, corresponding parts are numbered the same. For purposes of clarity, the sectional views do not strictly follow the section lines indicated. Deviations from the section lines were taken so that the internal components of the cleaner would not have to be shown in section.

DETAILED DESCRIPTION OF THE INVENTION

Figure 1:
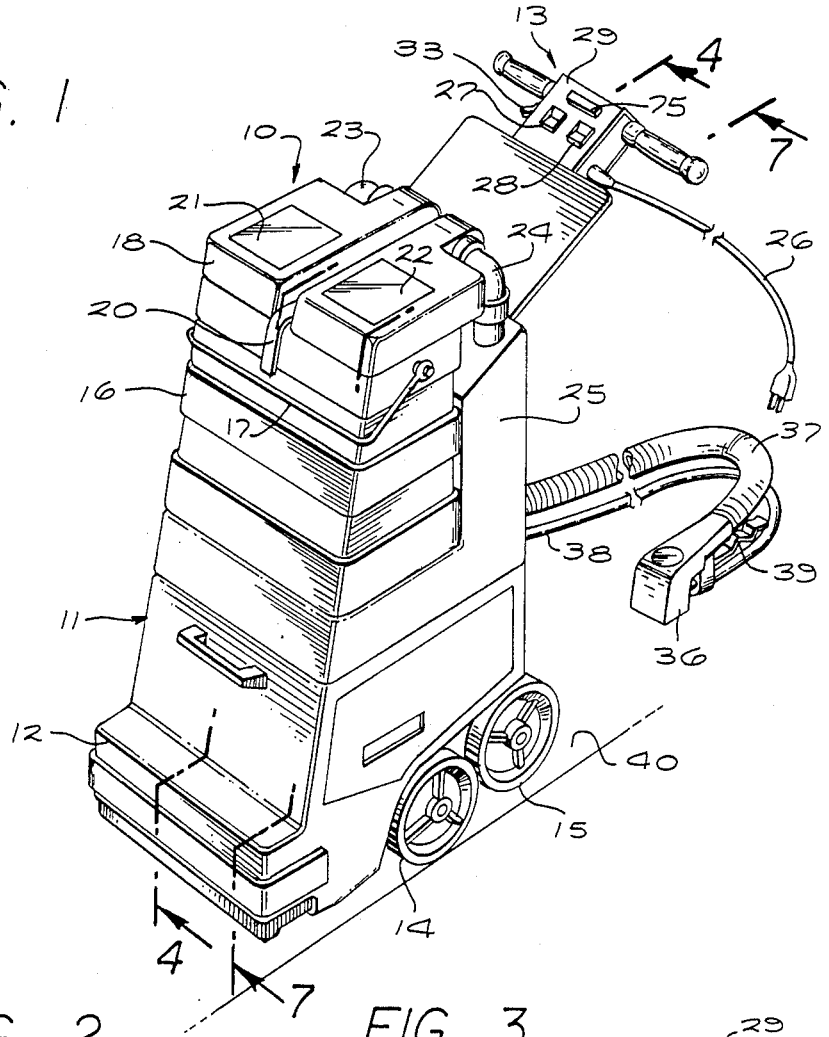
FIG. 1 is a perspective view of a rug or carpet cleaning device which embodies features of the invention.
Figure 4:
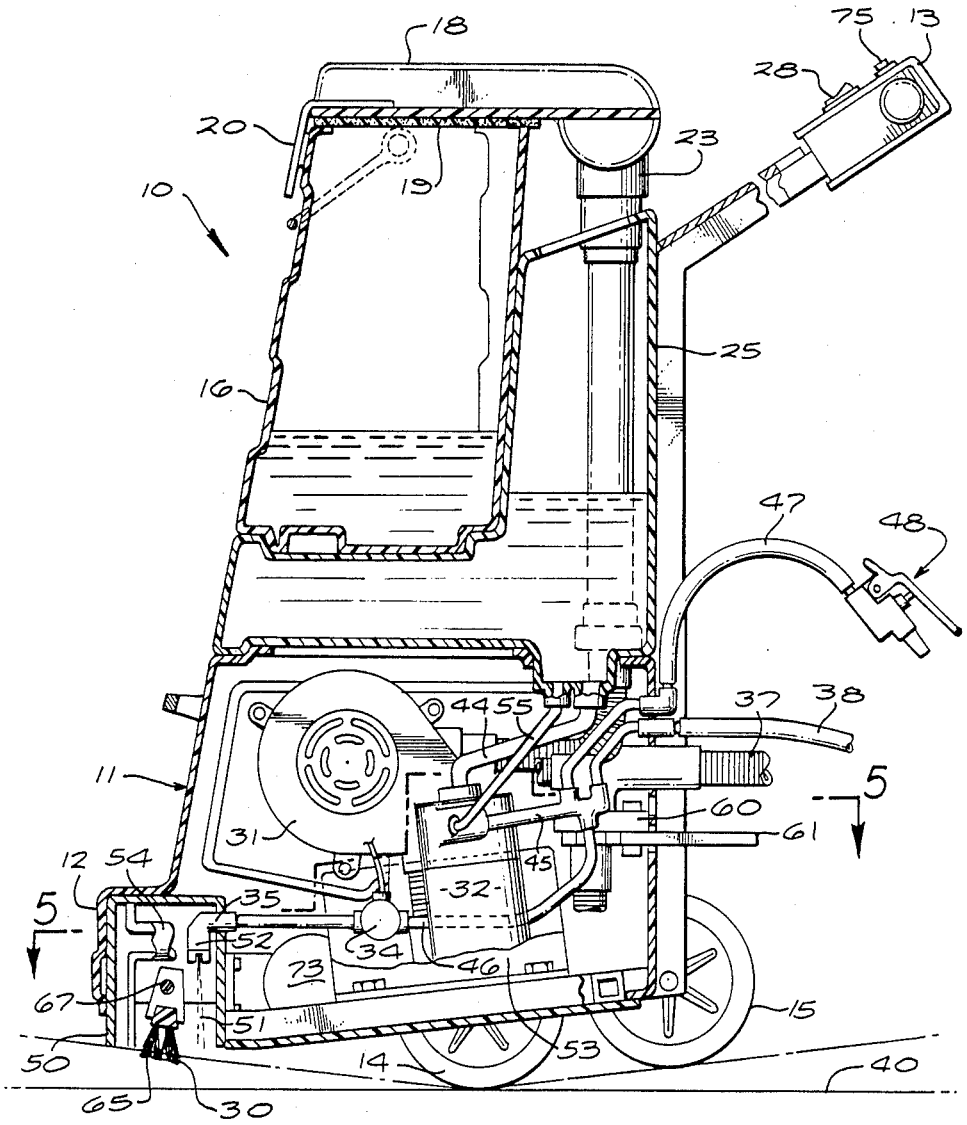
FIG. 4 is a cross-sectional view taken along the lines of 4—4 shown in FIG. 1.
Figure 7:
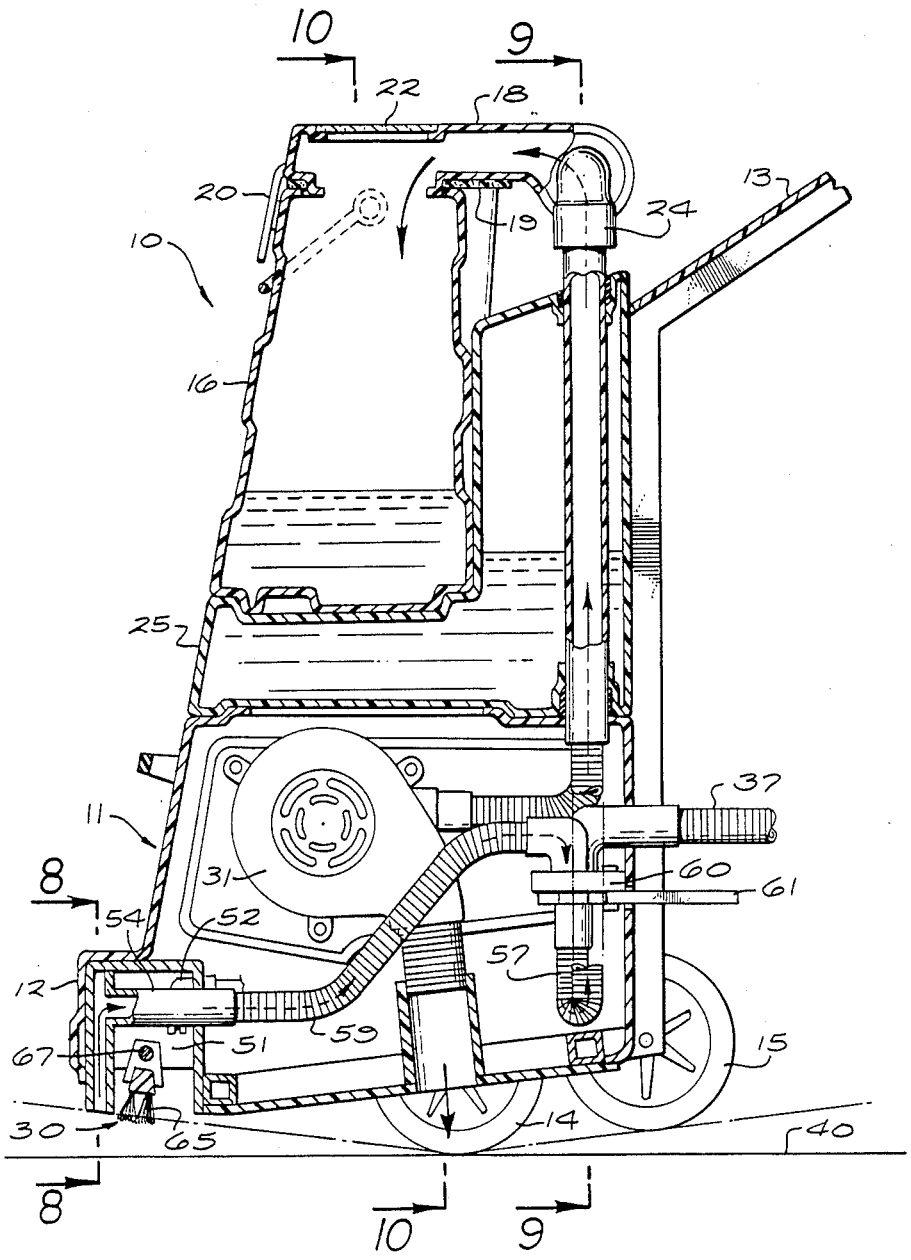
FIG. 7 is a side cross-sectional view taken along lines 7—7 shown n FIG. 1.

Reference is made to FIGS. 1, 4 and 7 which illustrate a rug and carpet cleaning device 10 which embodies features of the invention. The cleaning device 10 comprises a mobile support housing generally shown at 11, a cleaning head 12, handles 13, front wheels 14 and rear wheels 15. A removable tank 16 is provided in the upper portion of the housing 11 for collecting used or spent cleaning solution. A handle 17 is provided on the tank to facilitate removal and handling. A tank top 18 is provided to close off the upper open end of tank 16 which is maintained under a partial vacuum during the operation of the cleaning apparatus. An elastomeric seal 19 is disposed between the top 18 and the upper edge of tank 16 to ensure maintenance of the partial vacuum in the tank. The top 18 is pivotally mounted to the vacuum system conduits 23 and 24 and has sight glasses 21 and 22. Conduit 23 connects the tank 16 with a vacuum source 31, whereas conduit 24 leads an air stream which is entrained with spent cleaning solution to the tank where it is separated therefrom. Tank 25 disposed partially underneath tank 16 contains unused cleaning solution which is to be applied to the rug or carpet. Electric cable 26 provides the appropriate electrical power to the electrical devices of the cleaning unit. Switches 27 and 28 are located on panel 29. Switch 27 operates an oscillatory brush 30 in the cleaning head 12, and switch 28 operates both the vacuum source 31 and the cleaning solution pump 32. Switch 33 mounted on the handle 13 actuates a solenoid valve 34 which controls the flow of cleaning solution from tank 25 to the spray header 35.

An auxiliary cleaning head 36 is provided with the cleaning unit 10 and is operatively connected thereto by vacuum tube 37 and cleaning solution tube 38. The auxiliary head 36 is operated by the hand actuated switch 39 located on the underside of the head.

Figure 2:
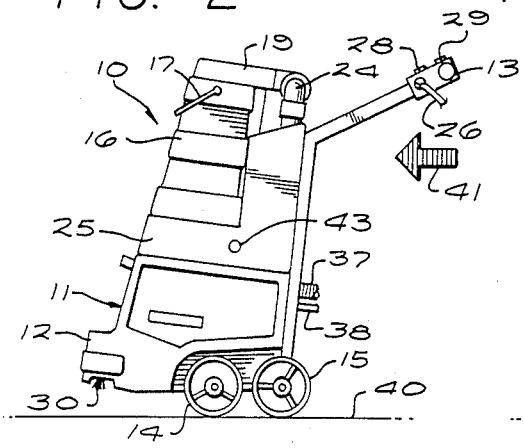
FIG. 2 and 3 are side views of the cleaning device shown in FIG. 1 which illustrate respectively the upright and tilted positions of the cleaning device.
Figure 3:
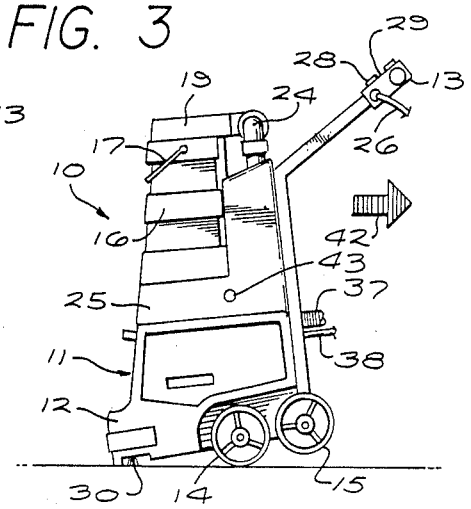

The engagement of the cleaning head 12 with a rug or carpet 40 is best shown in FIGS. 2 and 3. FIG. 2 illustrates the cleaning unit 10 in a upright position resting on both the front and rear wheels 14 and 15 respectively. The arrow 41 illustrates the normal direction of travel for non-operating movement. The FIG. 3 illustrates the cleaning unit 10 in a tilted position wherein the cleaning unit 10 has been rotated about the axis of rotation on which the front wheels 14 are mounted. The arrow 42 shows the normal direction of travel. The center of gravity is indicated by circle 43. As is evident in FIG. 2 when cleaner 10 is in the upright position the axis of rotation of the front wheels 14 is forward of the center of gravity 43, whereas, when in the tilted position, as shown in FIG. 3, the axis of rotation is rearward of the center of gravity. As shown in FIG. 2, the cleaning unit 10 in the upright position can be easily moved to a desired location on both the front wheels 14 and rear wheels 15. When the cleaning function is desired, the unit 10 is tilted about the axis of the front wheels 14 so that the cleaning head can engage the rug or carpet. In this mode the cleaner 10 is pulled backwardly during the cleaning operation with the unit pulling on the front wheels 14 alone. As is evident, the resultant moment on the cleaning unit 10 due to the pulling on the handles 13 during the cleaning operation must not be so great that the cleaning unit 10 is pulled back onto the upright position.

Figure 5:
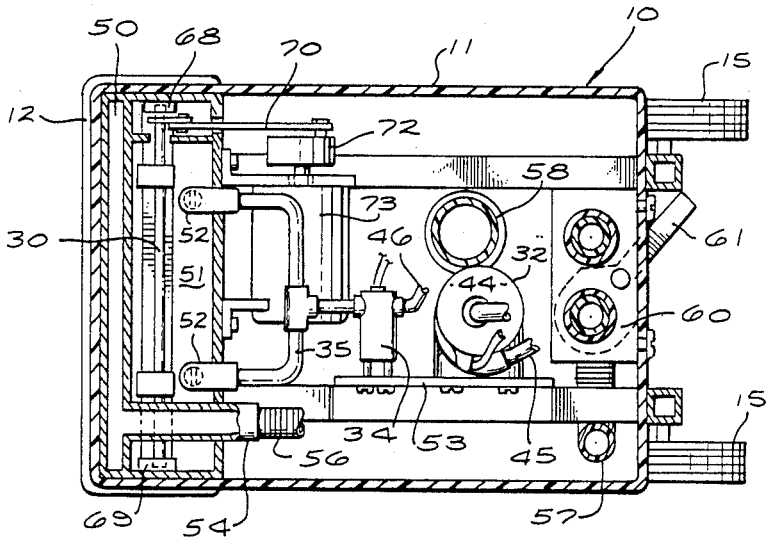
FIG. 5 is a cross-sectional view of the lower section of the cleaning unit taken along the lines 5—5 shown in FIG. 4.
Figure 6:
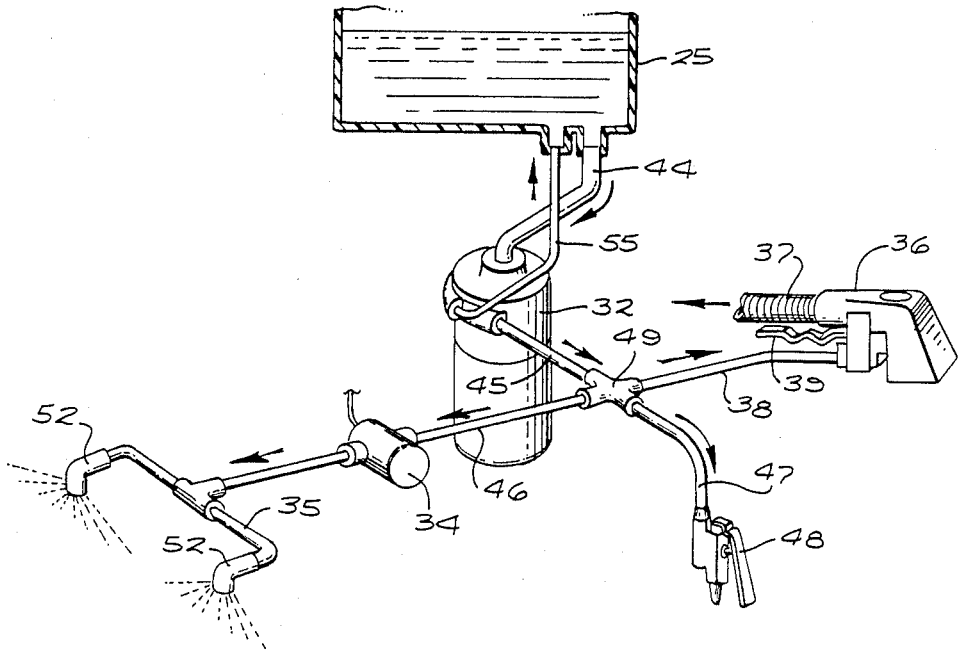
FIG. 6 is a perspective view of the cleaning solution delivery system of the cleaning unit shown in FIGS. 1-5.

The cleaning solution delivery system is best shown in FIGS. 4, 5 and 6. This system includes a conduit 45 which is connected to the lower part of the reservoir 25 to transfer cleaning solution from the reservoir to the cleaning solution pump 32 which pumps the solution through conduit 46 to the spray header 35 located adjacent the cleaning head 12. Spray header 35 directs the cleaning fluid to nozzles 52 which spray the solution onto the rug or carpet 40. Conduit 45 is also maintained in fluid communication with conduit 47 which directs cleaning solution to a spotting unit 48 and with conduit 38 which directs cleaning solution to the auxiliary cleaning head 36 by means of four way connector 49. Solenoid valve 34 in conduit 46 controls the flow of fluid to the spray header 35.

The cleaning head 12 as illustrated in FIGS. 4, 5, 7 and 11, has two chambers, a first vacuum chamber or nozzle 50 at the front end of the cleaning head 12 for aspirating cleaning fluid from the rug or carpet 40 which has been sprayed thereon and a second spray chamber 51 rearward of the vacuum chamber 50 which has one or more spray nozzles 52 in fluid communication with spray header 35 for directing cleaning fluid onto underlying rug or carpet 40. An oscillating brush 30 is also pivotally mounted in spray chamber 51 for working cleaning solution into the fibers of the rug or carpet 40 in a gentle manner so that there is little damage or wear thereto.

The vacuum chamber or nozzle 50 is in fluid communication with the vacuum system by means of a conduit 54 which passes through the spray chamber 51 and which is connected to conduit 56 of the vacuum system.

As best illustrated in FIGS. 4 and 7, the cleaning solution pump 32 is provided with a recirculating conduit 55 at the discharge end thereof which is in fluid communication with the tank or reservoir 25 containing unused cleaning solution. In this manner, while the solution pump 32 is operating, cleaning solution is continuously recirculated back to the holding tank or reservoir 25. Because the pump operates continuously, cleaning solution is always available under pressure to the spotting unit 48 and the auxiliary cleaning head 36. Moreover, because of the recirculating line 55 the operation of the solenoid valve 34 in line 46 does not subject the entire fluid delivery system to the sudden increase in fluid pressure which can damage lines and cause leaks in connectors and in pump seals. As shown in FIGS. 4 and 5, the solenoid valve 34 is supported from the bracket 53 bolted to a support frame which is part of the support housing 11.

The vacuum system as best illustrated in FIGS. 5, 7 and 9-11 includes a vacuum source or pump 31 which establishes a partial vacuum in container 16 through conduits 23 and 59. The partial vacuum established in container 16 draws in air through conduits 24, 54 and 57 with conduit 54 being connected to the vacuum chamber or nozzle 50 located in the cleaning head 12. The partial vacuum generated in the vacuum nozzle 50 aspirates cleaning solution which has been sprayed onto the rug or carpet through spray nozzles 52 and dirt and other debris from the rug or carpet 40 as shown by the arrow in FIG. 11, and is carried by the aspirating air stream to the tank 16 where the used or spent cleaning solution is separated from the air stream. The air stream pulled through the vacuum system by the vacuum pump 31 is discharged through conduit 58 shown in FIG. 10.

Figure 9:
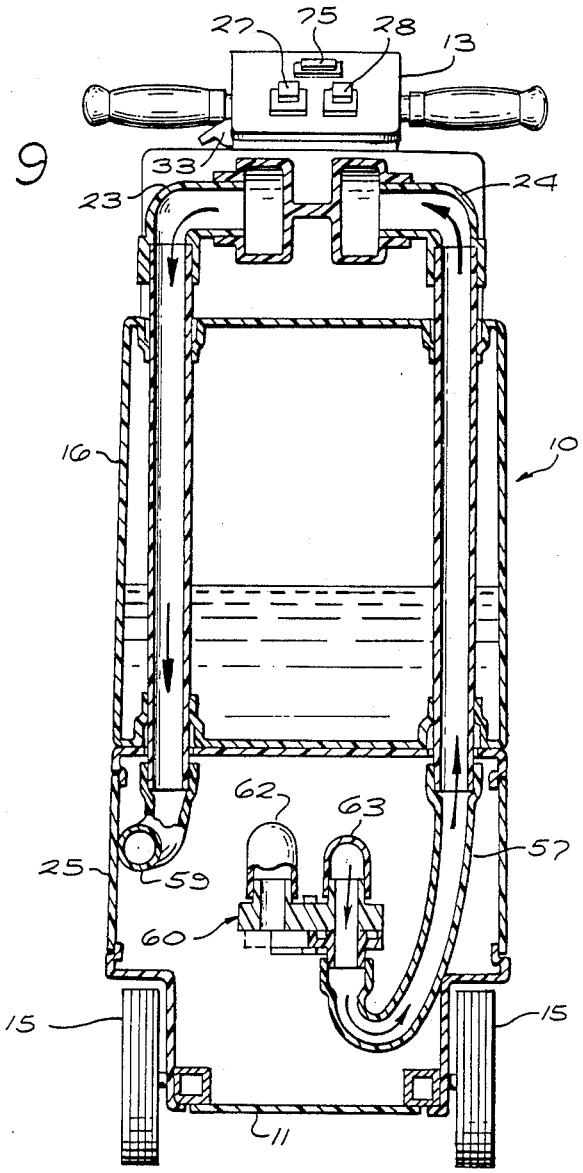
FIG. 9 is a sectional view taken along the lines 9—9 as shown in FIG. 7.
Figure 10:
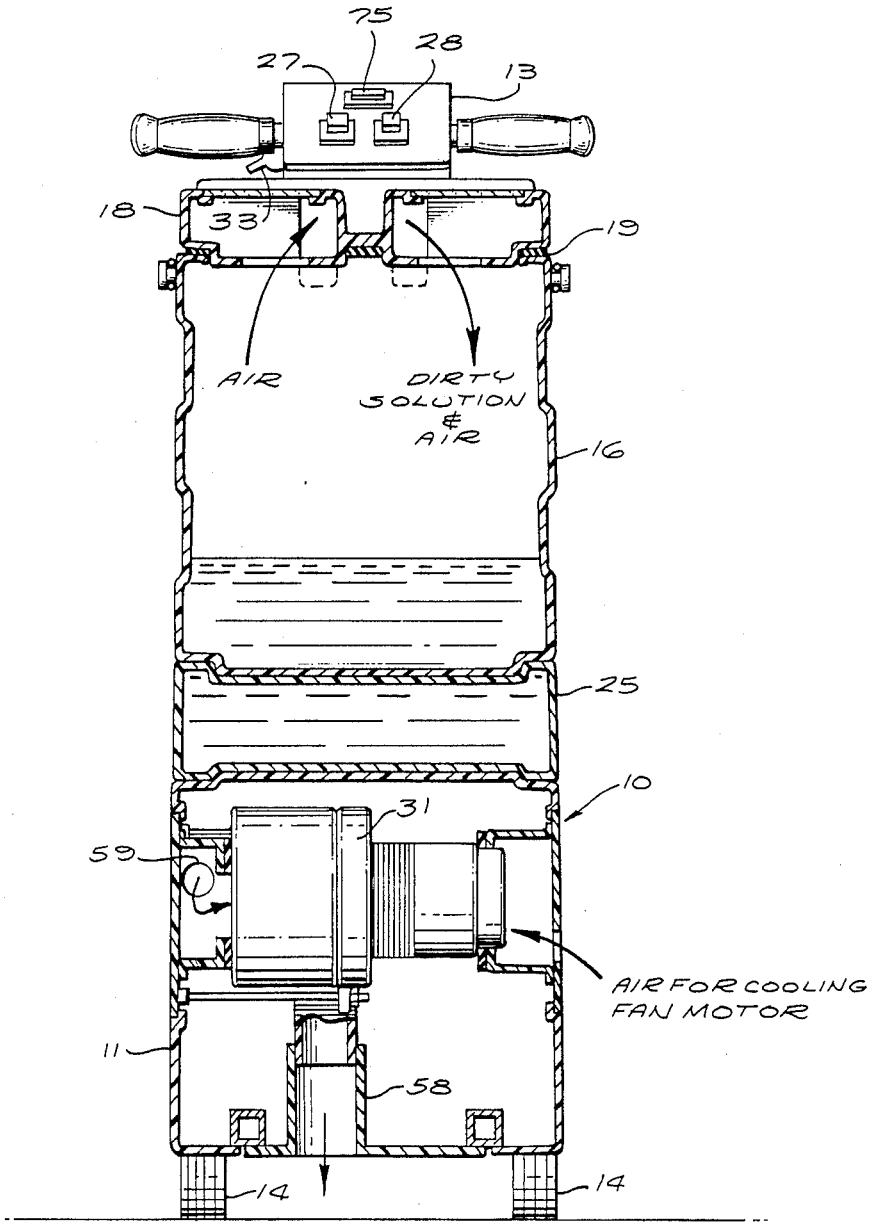
FIG. 10 is a cross-sectional view taken along the line 10—10 shown in FIG. 7.
Figure 11:
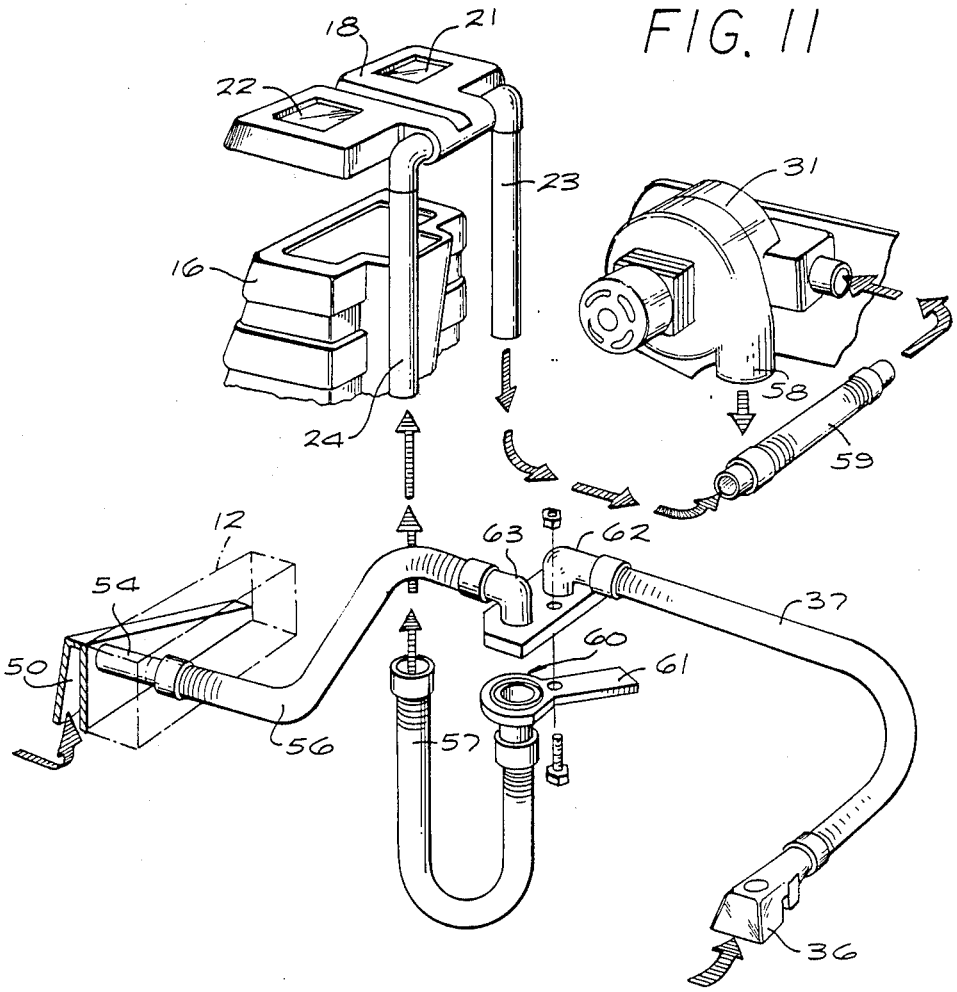
FIG. 11 is a perspective view of the vacuum system of the cleaner shown in the prior drawings.

As indicated in FIGS. 9 and 11, the vacuum line 37 to the auxiliary cleaning head 36 is connected to the vacuum system by means of a swing valve 60. The handle 61 thereof is rotated clockwise so that the end of the vacuum conduit 24 is in alignment and in fluid communication with elbow 62 which in turn is attached to and in fluid communication with vacuum line 37 of the auxiliary cleaning head 36. To return the vacuum system to the vacuum nozzle 50 in the cleaning head 12, the handle 61 is rotated counterclockwise to align the end of vacuum conduit 56 with the elbow 63 which in turn is interconnected with the vacuum conduit 57.

Figure 8:
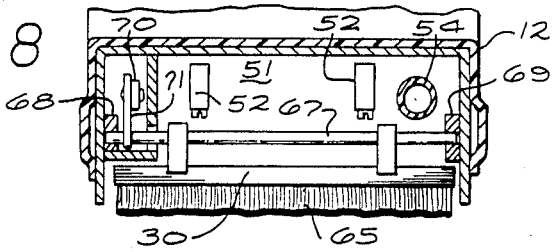
FIG. 8 is a frontal view in section taken along the lines 8—8 as shown in FIG. 7.

The operation of the oscillating brush 30 is shown in FIGS. 5 and 8. The brush 30 having bristles 65 thereon is fixed to a bar 67 which is journaled at each end thereof to bearings 68 and 69 on the inside surface of spray chamber 51 in the cleaning head 12. Drive arm 70 is pivotally connected at one end thereof to bracket 71 fixed to the bar 67 and pivotally connected at the other end thereof to the drive wheel 72. The end of drive arm 70 is mounted off-center on the drive wheel 72 so that reciprocating motion of the drive arm 70 results when the drive motor 73 rotates the drive wheel 72. The angular movement of the brush 30 about the axis of bar 67 should not exceed 45° from the vertical, i.e., a total angle of oscillation not greater than 90°. Additionally, the oscillating frequency may range up to about 28 Hz. Oscillation frequencies much greater than 28 Hz and angular movements greater than 45° from the vertical tend to cause excessive wear to the rug or carpet fibers. The brushing element 30 gently works the cleaning solution into the fibers of the rug or carpet 40 and aids in dislodging dirt and other debris from the fibers so that the partial vacuum in the vacuum nozzle 50 can aspirate both the cleaning solution and the dislodged dirt and other debris.

Figure 12:
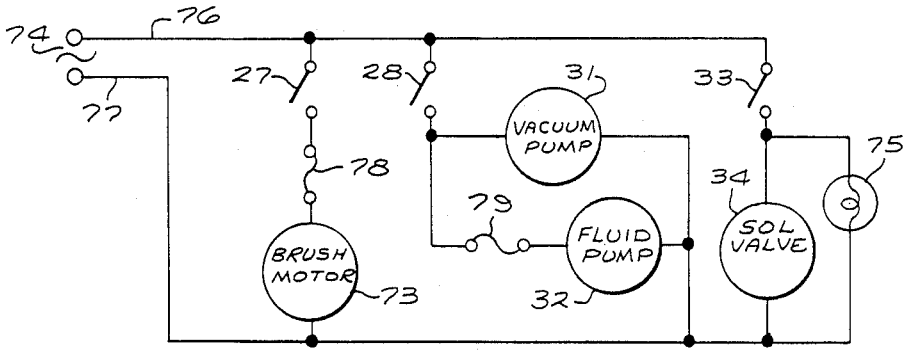
FIG. 12 is a schematic circuit diagram for the electrical components of the cleaner shown.

The electronic circuit for controlling the brush motor 23, the vacuum pump or blower 31, cleaning solution pump 32 and the solenoid valve 34 is shown in FIG. 12. The power source 74 may be a conventional 115 volt AC soure. Electric power cable 26 comprises conductors 76 and 77 which direct the elecrical power to the brush motor 73, the vacuum source or pump 31, the cleaning solution pump 32 and solenoid valve 34. Switch 27 activates the brush motor 73, whereas switch 28 actuates both the vacuum pump 31 and the cleaning solution pump 32. Switch 33 activates the solenoid valve 34. The indicating light 75, which is located on the panel 29 indicates when lit that the solenoid valve 34 is open and cleaning solution is flowing to the spray nozzles 52 in the cleaning head 12. Only the brush motor 73 and the cleaning solution pump require fuses as shown respectively at 78 and 79.

To operate the cleaning device of the invention, the unit is pushed in an upright position to a desired location. Switch 28 is actuated to operate the vacuum and fluid delivery systems and switch 27 is actuated to operate the oscillating brush 30. The cleaner unit 10 is tilted about the axis of rotation of the front wheels 14 so the cleaning head 12 can engage the rug or carpet 40. Switch 33 on handle 13 is actuated by the operator to open up the solenoid valve 34 to allow cleaning solution to pass through line 46 from tank 25 to the spray header 35 where the solution is applied to the rug or carpet 40 through spray nozzles 52. While the cleaning unit 10 is pulled along the rug backwardly in the tilted position, cleaning solution is sprayed onto the rug 40 and worked into the carpet by brush 30 and then the cleaning solution is removed from the rug along with the dirt and other debris which is dislodged therefrom by the vacuum nozzle 50. As needed, tank 25 is filled with fresh cleaning solution and tank 16 is removed from the housing 11 so that spent cleaning solution therein can be discarded. The cleaning solution is preferably a hot aqueous detergent solution although other aqueous and non-aqueous cleaning fluids can be used.

It is obvious that modifications can be made to the present invention without departing from the scope thereof. For example, the cleaning device of the invention is described herein in terms of a rug and carpet cleaner; however, the device can be used to clean a variety of surfaces.

What is claimed is:

1. A surface cleaning unit having a mobile support housing, said cleaning unit comprising:

a cleaning head having means for applying cleaning fluid onto an underlying surface, means for vacuuming the applied cleaning fluid from the surface, and an oscillating brush for working the cleaning fluid into the underlying surface;

an auxiliary cleaning head having means for applying cleaning fluid onto a surface and means for vacuuming the applied cleaning fluid from the surface, the auxiliary head being removable from the housing and operatively connected thereto by a vacuum line and a cleaning fluid line;

a vacuum system for maintaining a partial vacuum in the auxiliary cleaning head and in a vacuum chamber associated with the cleaning head;

means for selectively directing the partial vacuum to the vacuum chamber or to the auxiliary cleaning head;

a cleaning fluid delivery system for delivering cleaning fluid from a reservoir to the cleaning head and to the auxiliary cleaning head; and front wheels mounted to the support housing about a common housing axis and at least one rear wheel to support the cleaning unit is an upright stable position, wherein the cleaning unit is capable of being tilted forwardly about the housing axis to a tilted position wherein the cleaning head engages the underlying surface and the at least one rear wheel is lifted off the underlying surface, the cleaning unit being balanced such that the housing axis is disposed forward of the center of gravity of the cleaning unit in the upright position and rearward of the center of gravity of the cleaning unit when moved to the tilted position, the cleaning unit being balanced to remain in either selected position whether the cleaning unit is turned on or off.

2. The surface cleaning unit of claim 1, wherein the means for selectively directing the partial vacuum includes a swing valve which selectively connects the vacuum chamber with the vacuum system or connects the auxiliary cleaning head with the vacuum system.

3. The surface cleaning unit of claim 2, wherein the swing valve includes a manually operated handle which is rotated to direct the vacuum to the cleaning head or to the auxiliary cleaning head.

4. The surface cleaning unit of claim 2, wherein the vacuum system includes a waste recovery tank system for spent cleaning fluid comprising:

a removable tank included in the support housing for collecting spent cleaning fluid, the tank being maintained under a partial vacuum during operation of the cleaning unit;

first conduit means which connects the tank with the vacuum system; and second conduit means which leads an air stream including spent cleaning fluid to the tank, the air stream being received by the tank from either the cleaning head or the auxiliary cleaning head, as determined by the swing valve.

5. The surface cleaning unit of claim 1, wherein the cleaning fluid delivery system includes:

a cleaning fluid pump which operates continuously during operation of the cleaning unit;

cleaning fluid lines which connect the pump in fluid communication with the cleaning head and the auxiliary head;

a solenoid valve, located in the cleaning fluid lines, which directs the flow of cleaning fluid to the cleaning head or to the auxiliary cleaning head; and a recirculating conduit provided at a discharge end of the fluid pump which continuously recirculates cleaning fluid back to the reservoir such that operation of the solenoid valve does not subject the entire cleaning fluid delivery system to a sudden increase in fluid pressure.

6. A rug or carpet cleaning unit having a mobile support housing, said cleaning unit comprising:

a cleaning head having means for applying cleaning fluid onto an underlying rug or carpet, and means for vacuuming the applied cleaning fluid from the rug or carpet;

an auxiliary cleaning head having means for applying cleaning fluid onto a surface and means for vacuuming the applied cleaning fluid from the surface, the auxiliary head being separate from the housing and operatively connected thereto by a vacuum line and a first cleaning fluid line;

a vacuum system for selectively maintaining a partial vacuum in the auxiliary cleaning head or in a vacuum chamber associated with the cleaning head;

a spotting unit which comprises a spray nozzle separate from the housing and operatively connected thereto by a second cleaning fluid line; and a cleaning fluid delivery system for delivering cleaning fluid from a reservoir to the cleaning head, to the auxiliary cleaning head, and to the spotting unit.

7. The rug or carpet cleaning unit of claim 6, wherein the cleaning fluid delivery system includes:

a cleaning fluid pump which operates continuously during operation of the cleaning unit;

cleaning fluid lines which connect the pump in fluid communication with the cleaning head, the auxiliary head and the spotting unit;

a solenoid valve, located in the cleaning fluid lines, which directs the flow of cleaning fluid to the cleaning head or to the auxiliary cleaning head and the spotting unit; and a recirculating conduit provided at a discharge end of the fluid pump which continuously recirculates cleaning fluid back to the reservoir such that operation of the solenoid valve does not subject the entire cleaning fluid delivery system to a sudden increase in fluid pressure.

8. The rug or carpet cleaning unit of claim 6, including front wheels mounted to the support housing about a common housing axis and at least one rear wheel to support the cleaning unit in an upright stable position, wherein the cleaning unit is capable of being tilted forwardly about the housing axis to a tilted position wherein the cleaning head engages the underlying surface and the at least one rear wheel is lifted off the underlying surface, the cleaning unit being balanced such that the housing axis is disposed forward of the center of gravity of the cleaning unit in the upright position and rearward of the center of gravity of the cleaning unit when moved to the tilted position, the cleaning unit being balanced to remain in either selected position whether the cleaning unit is turned on or off.

9. The rug or carpet cleaning unit of claim 6, including means for ensuring that cleaning fluid is always available under pressure to the spotting unit and to the auxiliary cleaning head during operation of the unit.

10. The rug or carpet cleaning unit of claim 6, wherein the vacuum system includes means for selectively directing the partial vacuum to the vacuum chamber of the cleaning head or to the auxiliary cleaning head.

11. The rug or carpet cleaning unit of claim 10, wherein the vacuum system includes a recovery system for spent cleaning fluid comprising:

a removable tank included in the support housing for collecting spent cleaning fluid, the tank being maintained under a partial vacuum during operation of the cleaning unit;

first conduit means for connecting the tank with the vacuum system; and second conduit means for leading an air stream containing spent cleaning fluid to the tank, the air stream being received by the tank from either the cleaning head or the auxiliary cleaning head, as determined by the means for selectively directing the partial vacuum.

12. The rug or carpet cleaning unit of claim 6, wherein the reservoir includes sight glasses which allow determination of the fluid level in the reservoir.

13. A rug or carpet cleaning unit having a mobile support housing, said cleaning unit comprising:

a cleaning head having means for applying cleaning fluid onto an underlying carpet, means for vacuuming the applied cleaning fluid from the carpet, and an oscillating brush for working the cleaning fluid into the underlying carpet;

an auxiliary cleaning head having means for applying cleaning fluid onto a surface and means for vacuuming the applied cleaning fluid from the surface, the auxiliary head being removable from the housing and operatively connected thereto by a vacuum line and a first cleaning fluid line;

a vacuum system for maintaining a partial vacuum in the auxiliary cleaning head and in a vacuum chamber associated with the cleaning head, the vacuum system including means for selectively directing the partial vacuum to the vacuum chamber or to the auxiliary cleaning head, comprising a swing valve positioned by a manually operated handle to connect the vacuum chamber with the vacuum system via a first vacuum line or to connect the auxiliary cleaning head with the vacuum system via a second vacuum line;

a manually operated spotting unit having a spray nozzle separate from the housing and operatively connected thereto by a second cleaning fluid line;

a recovery system for spent cleaning fluid comprising a removable tank included in the support housing for collecting spent cleaning fluid, the tank being maintained under a partial vacuum during operation of the cleaning unit, first conduit means which connects the tank with the vacuum system, and second conduit means for leading an air stream containing spent cleaning fluid to the tank, the air stream being received by the tank from either the cleaning head or the auxiliary cleaning head, as determined by the means for selectively directing the partial vacuum; and a cleaning fluid delivery system for delivering cleaning fluid from a reservoir to the cleaning head, to the auxiliary cleaning head and to the spotting unit, wherein the delivery system includes a cleaning fluid pump which operates continuously during operation of the cleaning unit, cleaning fluid lines which connect the pump in fluid communication with the cleaning head, the auxiliary head and the spotting unit, means for diverting pumped fluid into three different streams after the fluid exists the pump, the streams being carried by the fluid lines to the cleaning head, the auxiliary cleaning head and the spotting unit, a solenoid valve, located in the cleaning fluid lines, which controls the flow of cleaning fluid to the cleaning head, and a recirculating conduit provided at a discharge end of the fluid pump which continuously recirculates cleaning fluid back to the reservoir such that operation of the solenoid valve does not subject the entire cleaning fluid delivery system to a sudden increase in fluid pressure.

14. The cleaning unit of claim 13, including front wheels mounted to the support housing about a common housing axis and at least one rear wheel to support the cleaning unit in an upright stable position, wherein the cleaning unit is capable of being tilted forwardly about the housing axis to a tilted position wherein the cleaning head engages the underlying surface and the at least one rear wheel is lifted off the underlying surface, the cleaning unit being balanced such that the housing axis is disposed forward of the center of gravity of the cleaning unit in the upright position and rearward of the center of gravity of the cleaning unit when moved to the tilted position, the cleaning unit being balanced to remain in either selected position whether the cleaning unit is turned on or off.

15. The cleaning unit of claim 13, wherein the continuously operating pump ensures that cleaning fluid is always available under pressure to the spotting unit and the auxiliary cleaning head during operation of the unit.

16. The cleaning unit of claim 13, wherein the reservoir includes sight glasses which allow determination of the fluid level in the reservoir.

17. The cleaning unit of claim 13, wherein the means for diverting pumped fluid into three different streams comprises a four-way connector.

18. The cleaning unit of claim 13, wherein the brush oscillates through an angle of not more than 90° at a frequency of not more than 120 HZ.

19. A surface cleaning unit having a mobile support housing, said cleaning unit comprising:

a cleaning head having means for applying cleaning fluid onto an underlying surface and means for vacuuming the applied cleaning fluid from the underlying surface;

a vacuum system for maintaining a partial vacuum in a vacuum chamber associated with the cleaning head;

a cleaning fluid delivery system for delivering cleaning fluid from a reservoir to the cleaning head, wherein the delivery system includes a pump having a recirculating conduit which continuously recirculates cleaning fluid from the pump back to the reservoir; and front wheels mounted to the support housing about a common housing axis and at least one rear wheel to support the cleaning unit in an upright stable position, wherein the cleaning unit is capable of being tilted forwardly about the housing axis to a tilted position wherein the cleaning head engages the underlying surface and the at least one rear wheel is lifted off the underlying surface, the cleaning unit being balanced such that the housing axis is disposed forward of the center of gravity of the cleaning unit in the upright position and rearward of the center of gravity of the cleaning unit when moved to the tilted position, the cleaning unit being balanced to remain in either selected position wherein the cleaning unit is turned on or off.

20. The surface cleaning unit of claim 19 including a spotting unit removable from the housing and operatively connected thereto by a cleaning fluid line.

21. The surface cleaning unit of claim 19, including an auxiliary cleaning head having means for applying cleaning fluid onto a surface and means for vacuuming the applied cleaning fluid from the surface, the auxiliary head being removable from the housing and operatively connected thereto by a vacuum line and a cleaning fluid line.

22. The surface cleaning unit of claim 21, wherein the vacuum system includes means for selectively directing the partial vacuum to the vacuum chamber or to the auxiliary cleaning head.

23. The surface cleaning unit of claim 22, wherein the means for selectively directing the partial vacuum comprises a swing valve which is positioned by a manually operated handle.

24. The surface cleaning unit of claim 21, wherein the vacuum system includes a waste recovery tank system for spent cleaning fluid comprising:

a removable tank included in the support housing for collecting spent cleaning fluid, the tank being maintained under a partial vacuum during operation of the cleaning unit;

first conduit means for connecting the tank with the vacuum system; and second conduit means for leading an air stream including spent cleaning fluid to the tank, the air stream being received by the tank from either the cleaning head or the auxiliary cleaning head.

25. A surface cleaning unit having a mobile support housing, said cleaning unit comprising:

a cleaning head having means for applying cleaning fluid onto an underlying surface, means for vacuuming the applied cleaning fluid from the surface, and an oscillating brush for working the cleaning fluid into the underlying surface;

an auxiliary cleaning head having means for applying cleaning fluid onto a surface and means for vacuuming the applied cleaning fluid from the surface, the auxiliary head being removable from the housing and operatively connected thereto by a vacuum line and a cleaning fluid line;

a vacuum system for maintaining a partial vacuum in the auxiliary cleaning head and in a vacuum chamber associated with the cleaning head;

means for selectively directing the partial vacuum to the vacuum chamber or to the auxiliary cleaning head; and a cleaning fluid delivery system for delivering cleaning fluid from a reservoir to the cleaning head and to the auxiliary cleaning head, the cleaning fluid delivery system including:

a cleaning fluid pump which operates continuously during operation of the cleaning unit;

cleaning fluid lines which connect the pump in fluid communication with the cleaning head and the auxiliary head;

a solenoid valve, located in the cleaning fluid lines, which directs the flow of cleaning fluid to the cleaning head or to the auxiliary cleaning head; and a recirculating conduit provided at a discharge end of the fluid pump which continuously recirculates cleaning fluid back to the reservoir such that operation of the solenoid valve does not subject the entire cleaning fluid delivery system to a sudden increase in fluid pressure.

* * * * *

UNITED STATES PATENT AND TRADEMARK OFFICE

CERTIFICATE OF CORRECTION

PATENT NO. : 4,809,397

DATED : March 7, 1989

INVENTOR(S) : Paul G. Jacobs, et al.

It is certified that error appears in the above-identified patent and that said Letters Patent is hereby corrected as shown below:

In column 1, line 60, delete the word "most" and insert therefor --more--.

In column 3, line 15, delete the word "on" and insert therefor --of--.

In column 3, line 52, delete the word "n" and insert therefor --in--.

In column 7, line 38, delete the word "is" and insert therefor --in--.

In column 11, line 17, delete the word "wherein" and insert therefor --whether--.

Signed and Sealed this

Twenty-ninth Day of August, 1989

*Attest:*

*Attesting Officer*

DONALD J. QUIGG

*Commissioner of Patents and Trademarks*